United States Patent [19]

Haslau et al.

[11] 4,007,881

[45] Feb. 15, 1977

[54] COIL WINDING MACHINE

[75] Inventors: Horst Eugen Haslau; William Emerson Rigsbee, both of Indianapolis, Ind.

[73] Assignee: RCA Corporation, New York, N.Y.

[22] Filed: Sept. 6, 1974

[21] Appl. No.: 503,681

Related U.S. Application Data

[63] Continuation of Ser. No. 278,351, Aug. 7, 1972, abandoned.

[30] Foreign Application Priority Data

Feb. 22, 1972 United Kingdom ..... 8214/72

[52] U.S. Cl. ..... 242/4 B; 242/4 C

[51] Int. Cl.[2] ..... H01F 41/08

[58] Field of Search ..... 242/7.13, 7.14, 4 B, 242/4 BE, 4 R; 140/92.1, 71.5

[56] References Cited

UNITED STATES PATENTS

| | | | |
|---|---|---|---|
| 1,994,661 | 3/1935 | Pash | 242/4 B |
| 2,430,105 | 11/1947 | Conklin | 242/4 B |
| 2,430,106 | 11/1947 | Conklin | 242/4 B |
| 2,726,817 | 12/1955 | Barrows | 242/4 B |
| 3,227,383 | 1/1966 | Zywietz | 242/7.13 |
| 3,237,657 | 3/1966 | Elvers et al. | 242/7.13 X |
| 3,559,899 | 2/1971 | Fahrbach | 242/4 B |
| 3,810,587 | 5/1974 | Muskulus | 242/7.13 |

FOREIGN PATENTS OR APPLICATIONS

| | | | |
|---|---|---|---|
| 660,218 | 10/1951 | United Kingdom | 242/4 B |

*Primary Examiner*—Billy S. Taylor
*Attorney, Agent, or Firm*—Edward J. Norton; William Squire; Samuel Cohen

[57] ABSTRACT

A machine for winding toroidal coils useful as picture tube beam deflection yokes in television receivers includes a coil winding shuttle, a filament storage magazine and structure for selectively varying the angular rate of rotation of the shuttle during the winding of each turn of the coil so as to maintain the feed rate of the filament from the magazine to the shuttle at a substantially constant rate. Additionally, a double chamber magazine and a double acting clamp are provided which respectively permit winding of the entire yoke with two separate coils and winding each coil without displacing the yoke from its winding position.

4 Claims, 9 Drawing Figures

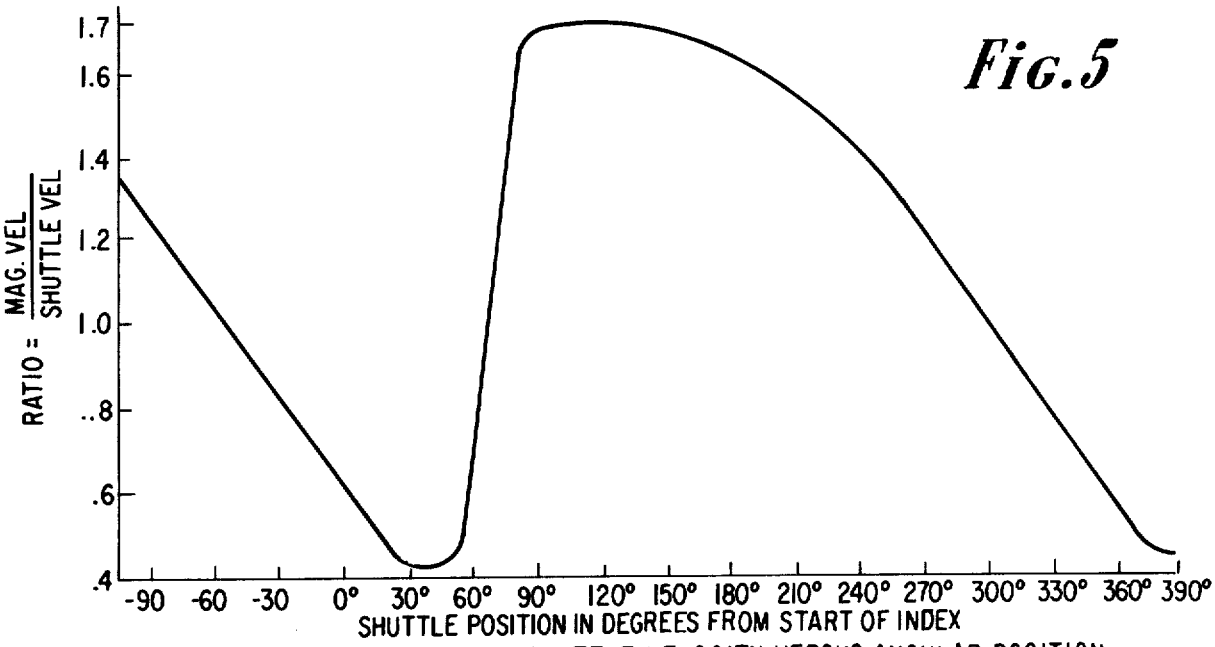
RATIO OF MAGAZINE VELOCITY TO SHUTTLE VELOCITY VERSUS ANGULAR POSITION OF SHUTTLE
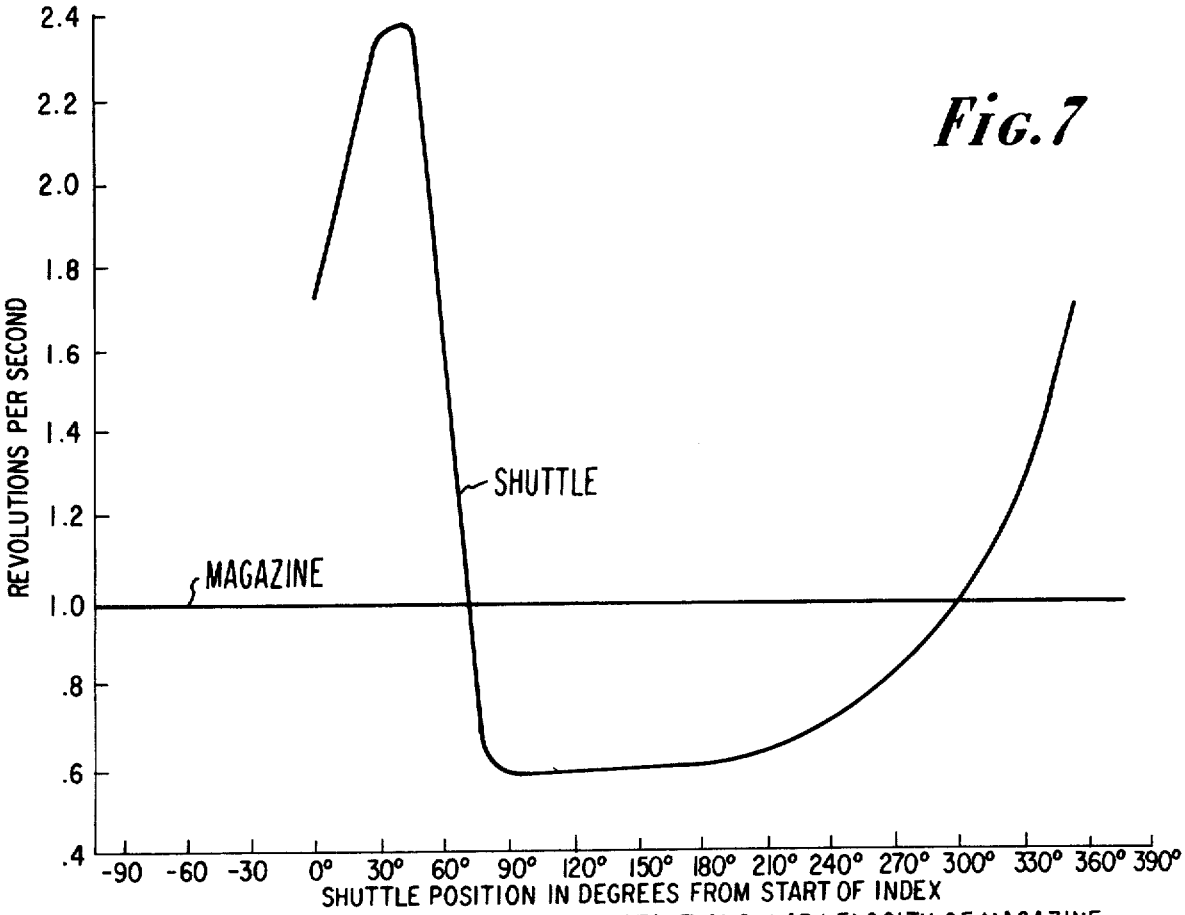
SHUTTLE ANGULAR VELOCITY VERSUS CONSTANT ANGULAR VELOCITY OF MAGAZINE

ANGULAR POSITION OF SHUTTLE VERSUS ANGULAR POSITION OF MAGAZINE

COIL WINDING MACHINE

This is a continuation of application Ser. No. 278,351, filed Aug. 7, 1972 and now abandoned.

BACKGROUND OF THE INVENTION

The present invention relates to coil winding machines.

In many instances of coil winding, especially in toroidal coil windings, the relationship between a coil and the shuttle which performs the winding of a filament about the core are not always symmetrical. Usually in these types of machines, the shuttle rotates about the core at a constant rate during each turn pulling the filament from a floating rotatably mounted magazine. The magazine usually includes tension devices which provide slip-clutch rotary braking action in a direction reverse to the direction to which the filament is pulled from the magazine. In effect, the magazine is rotated in the direction opposite of the shuttle so as to maintain tension on the dispensed filament.

Due to the asymmetrical spaced relationship between the shuttle and magazine to the coil, the amount of wire pulled from the magazine by the shuttle during each turn of the coil varies in accordance with the angular position of the shuttle with respect to that coil. To compensate for this asymmetrical condition, the tension devices provided at the magazine need to provide sufficient braking action so as to maintain the desired tension on the filament regardless of the variations in tension exerted on the filament then being dispensed. This action usually results in abrupt changes in motion of the magazine causing jerking of the filament, and in some instances, breakage of the filament. To prevent this undesirable condition from arising, the shuttles are operated at that maximum speed below which breakage of filament no longer occurs. This maximum speed is usually much less than the machine capability and therefore reduces the machine efficiency.

SUMMARY OF THE INVENTION

In accordance with the present invention, a coil winding machine is provided which includes coil winding means rotatably mounted on the machine for winding a filament into a coil. Filament storage means are rotatably mounted on the machine for supplying the filament to the coil winding means the amount of filament supplied being different in each of at least two portions of a coil turn. The filament storage means tends to have an irregular angular rate of rotation as a function of the amount of filament supplied the coil winding means during that portion of the coil turn then being wound such that the feed rate of the supplied filament is different in each of the two portions of the coil turn. Constant rate means are coupled to the filament storage means and the coil winding means for causing the coil winding means to wind the coil and for causing the filament storage means to rotate at a substantially constant rate during the winding of the coil turn irrespective of the amount of filament supplied the coil winding means to thereby preclude breakage of the filaments which might otherwise occur.

A feature of the invention includes a filament split ring magazine which serves as the filament storage means, the magazine having first and second adjacently disposed parallel channels extending around the periphery of the ring, each of the channels serving to store a separate different length of filament to be wound into separate different coils.

An additional feature of the machine includes core clamping means mounted on the machine, the clamping means including first and second spaced pairs of core clamping jaws, each pair being separately pivotally mounted on the machine, each pair having core clamp and unclamp positions in accordance with the pivoted position of that pair. As a result, the core about which a coil is to be wound is unclamped from the first pair of jaws and reclamped with the second pair of jaws during the winding cycle to switch clamping positions.

IN THE DRAWINGS

FIG. 1 is a perspective view of a winding machine constructed in accordance with the present invention, FIG. 2*a* is a fragmented enlarged view of the winding mechanism of the machine of FIG. 1, FIG. 2*b* is an end cross sectional view of the magazine, FIG. 2*c* is an enlarged end view of the guide plates guiding a filament into a core serration along line 2—2 of FIG. 2*a*, FIG. 3 is an exploded schematic view of the machine of FIG. 1 and includes a diagrammatic presentation of the controls by which the shuttle gear and indexing table of the machine of FIG. 1 operate in accordance with the present invention, FIG. 4 is a schematic side view of the shuttle and core useful in explaining the present invention, and FIGS. 5, 6 and 7 are curves useful in explaining the operation of the machine as constructed in accordance with the present embodiment of the invention.

DETAILED DESCRIPTION

Figure 1:
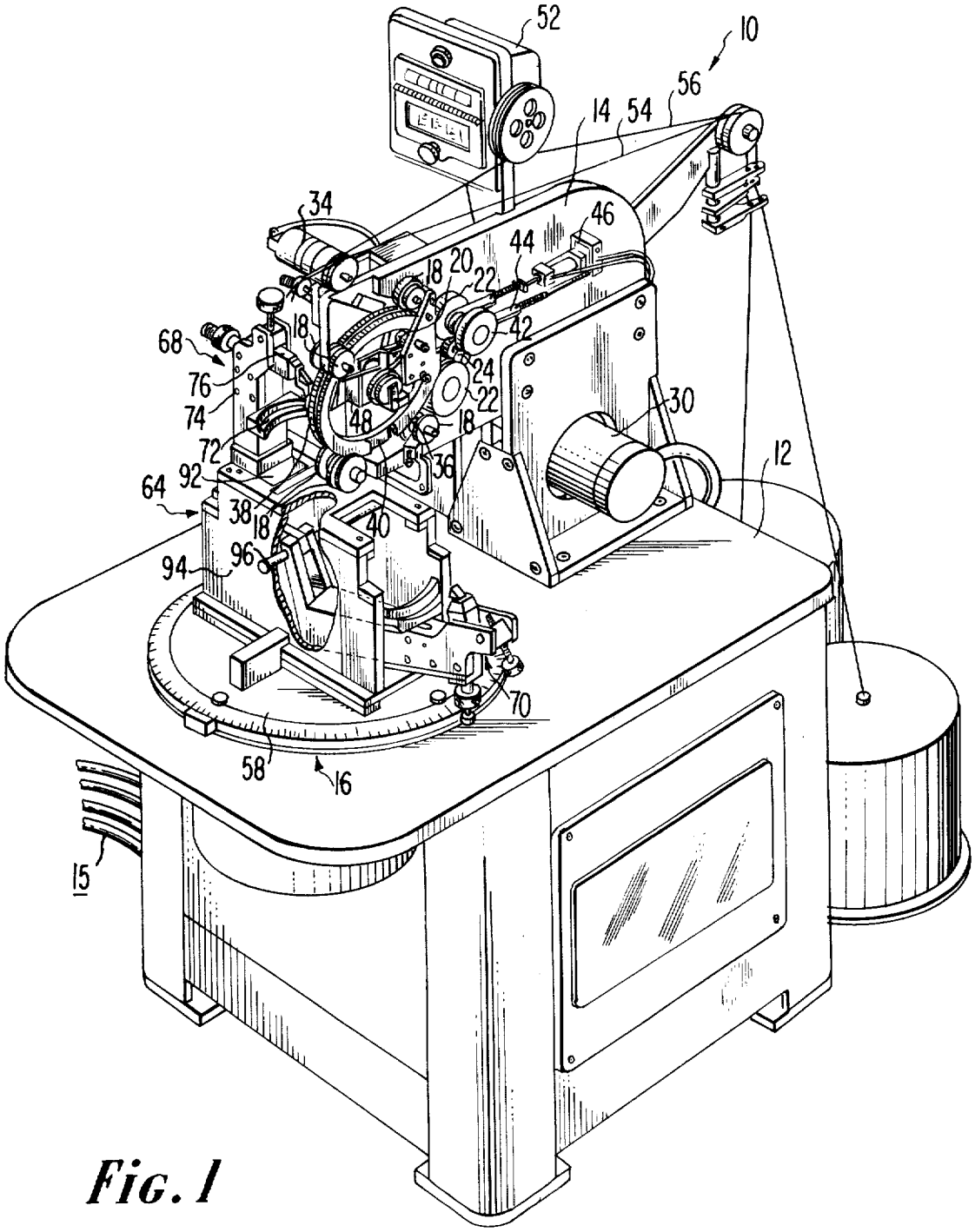

In FIG. 1 there is shown a winding machine 10 which includes a base 12, an upper frame 14 and an indexing table assembly 16. The controls by which the machine operates in accordance with the present invention are connected to the machine by way of cables 15 and will be explained in conjunction with FIG. 3.

Figure 3:
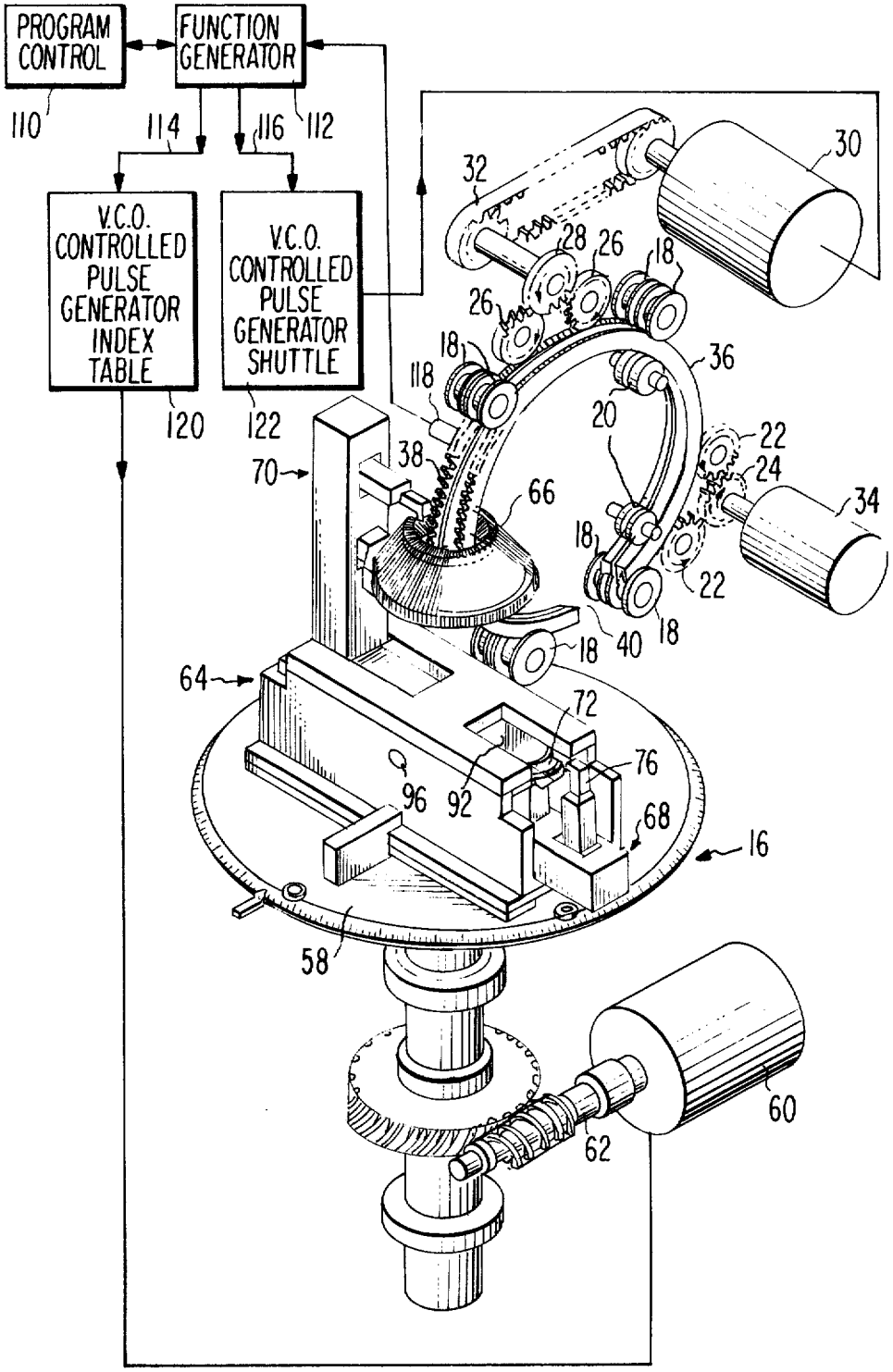

Mounted on frame 14 are four pairs of external idler rollers 18 each roller having a groove extending around the periphery thereof as shown. Two pairs of internal cylindrical idler rollers 20 (FIG. 3) are also mounted on frame 14. Mounted on the near side of frame 14 are two idler gears 22 and magazine drive gear 24. Disposed on the other side of frame 14 are two additional idler gears 26 (FIG. 3) and shuttle drive gear 28. Mounted to frame 14 is stepping motor 30 which serves to drive gear 26 by way of gear 28 which is connected to motor 30 by way of belt 32 (FIG. 3). Stepping motor 30 serves to drive gear 28 and, thus gears 26, at various angular velocities in accordance with an applied signal as will be explained. Motor 30 is a conventional stepping motor as used in numerical control machines and by way of example, rotates 1.8° for each applied input pulse.

A conventional slip-clutch air motor 34 is directly coupled to gear 24 so as to rotate idler gears 22 in a direction opposite from the direction of rotation of gears 26. Rotatably mounted within one of the rollers of each of roller pairs 18 and 20 is floating filament magazine 36 having an external gear extending around the periphery thereof in engagement with idler gears 22 so as to be rotated by gears 22 when air motor 34 is running.

Supported adjacent magazine 36 and coaxial therewith within the other rollers of roller pairs 18 and 20 is shuttle 38. Shuttle 38 has an external gear extending around the periphery thereof in engagement with gears 26. Both the shuttle 38 and magazine 36 have a split 40 therein (FIG. 3) for receiving a core in interlinked relation. Gears 26 rotate shuttle 38 in a direction opposite to the direction of rotation of magazine 36 by gears 22.

Figure 2A:
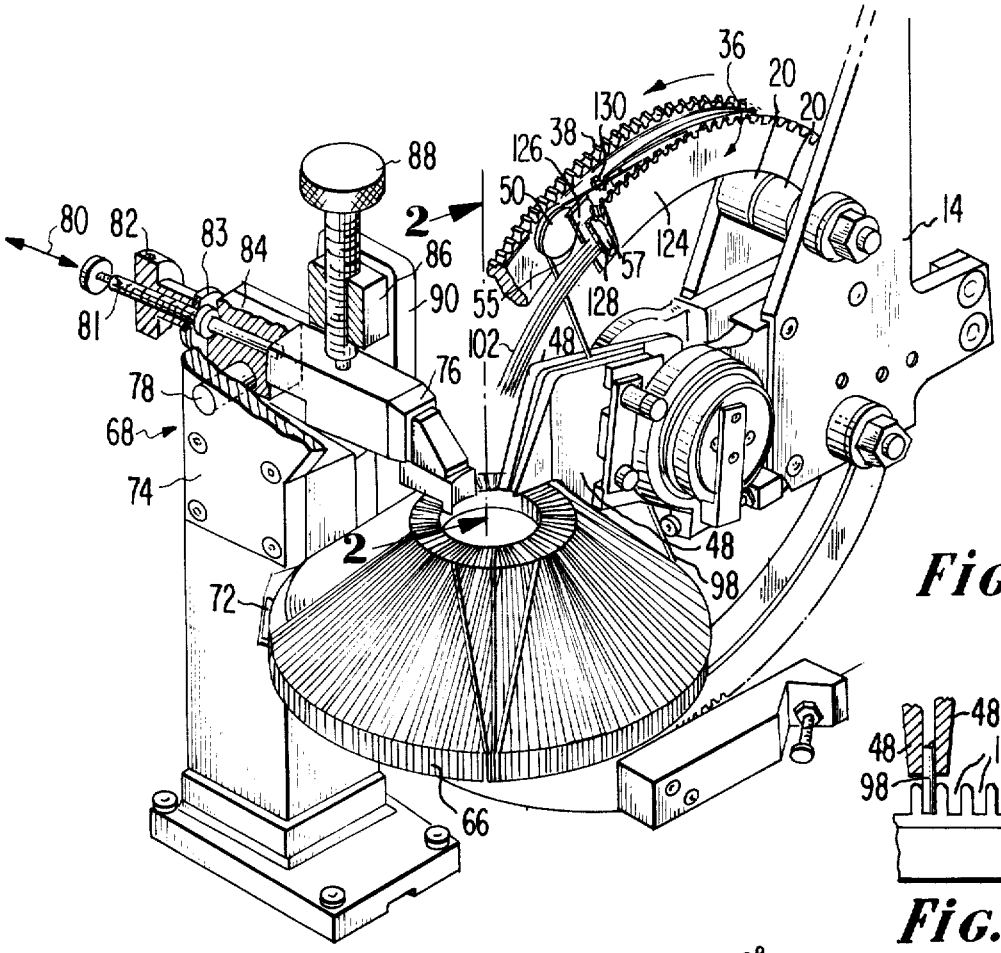
Figure 2C:
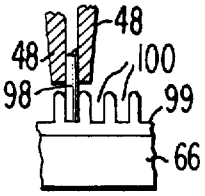

Coupled to one of idler gears 22 is pulley 42 which receives friction belt 44 resiliently mounted to frame 14 at one end thereof and wrapped around pulley 42 and connected at the other end to air cylinder 46. Belt 44 serves to provide a frictional braking load on magazine 36 by way of idler gear 22 as known in the coil winding machine art. Rotatably mounted and spaced within magazine 36 and shuttle 38 are resiliently mounted opposed facing spaced filament tension and guide plates 48 which guide the filament to be wound therebetween as best seen in FIG. 2*c*. Rotatably mounted on the wall of shuttle 38 disposed between shuttle 38 and magazine 36 is guide roller 50 (FIG. 2*a*) which is a grooved pulley and serves to guide the filament drawn from magazine 36. Roller 50 rotates with shuttle 38 about the axes 106 (FIG. 4) of shuttle 38. Footage counter 52 is provided to measure the length of filament to be stored on magazine 36 during loading. Air motor 34 serves to load the magazine with filament as well as provide braking action on the magazine during the coil winding operation.

Figure 2B:
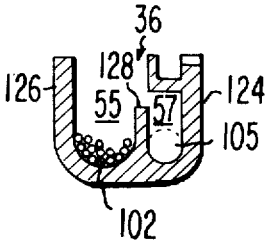

Magazine 36 is loaded with two separate lengths and types of filaments 54 and 56 simultaneously to form two filament bundles 102 and 105 (FIG. 2*b*). Footage counter 52 serves to count the length of both filaments to be stored on magazine 36 by counting the footage on the shortest length and then continuing the count with the longer length. Magazine 36, in accordance with the present invention, is provided the capacity to store two lengths of filament to be wound into a coil to permit the coil winding machine to wind two separate coils sequentially without breaking the setup between coil windings.

The geared relationship between shuttle 38 and stepping motor 30 is such that for every 1.8° step of motor 30, shuttle 38 rotates 0.45°, a four to one step down ratio.

Indexing table assembly 16 is rotatably mounted on base 12. As best seen in FIG. 3, assembly 16 includes indexing table 58 which is rotatably driven by stepping motor 60 by way of the worm gear arrangement illustrated. Stepping motor 60 also rotates 1.8° for each pulse applied at an input thereto. There is an eighteen to one step down ratio between the rotation of indexing table 58 to the rotation of shaft 62 of motor 60. As a result, table 58 rotates one tenth of a degree for each 1.8° rotation of shaft 62. Securely mounted in a suitable manner to indexing table 58 is core clamp assembly 64 for clamping a core 66 as used in television receiver tube yokes about which a toroidal coil is to be wound. In FIG. 2*a* a partially wound core 66 illustrates the plurality of turns of the filament wherein each turn is guided through grooves or serrations 100 provided in suitable inserts 99 and 101 (FIGS. 2*c* and 4) at the respective flat ends of the core. Indexing table assembly 16 serves to precisely index the core so that selected ones of the serrations 100 in the inserts are in coincidence with the interface of guide plates 48 disposed adjacent thereto as shown (FIG. 2*c*) so as to precisely align the filament disposed in the interface with that selected winding serration.

Core 66 is securely mounted to indexing table 58 by way of clamp assembly 64 which is mounted on table 58. Clamp assembly 64 includes two diametrically opposed pivotally mounted core clamping jaw assemblies 68 and 70. Assemblies 68 and 70 are substantially the same and, therefore, only one of assemblies 68 and 70 will be described. Jaw assembly 68 will be explained in conjunction with FIGS. 1 and 2*a* wherein assembly 68 comprises a lower jaw 72 securely mounted to upright member 74 and adapted to receive the lower vertical and horizontal external surfaces of the core on insert 101 as shown. Spaced directly above jaw member 72 is upper jaw 76 which is pivotally mounted by a pivot pin 78 and slidably mounted in transverse motion toward and away from core 66 in the radial direction as indicated by the arrow at 80. The transverse motion of jaw 76 is provided by captive nut 82 and threaded portion 81 of jaw 76 extending through captive nut 82. The threaded portion 81 of jaw 76 extends transversely through an aperture in pivot block 84 to which nut 82 is captured by washer 83. As knurled nut 82 is rotated, jaw 76 is transversely displaced in the direction of arrow 80 in accordance with the direction of rotation of nut 82.

Figure 4:
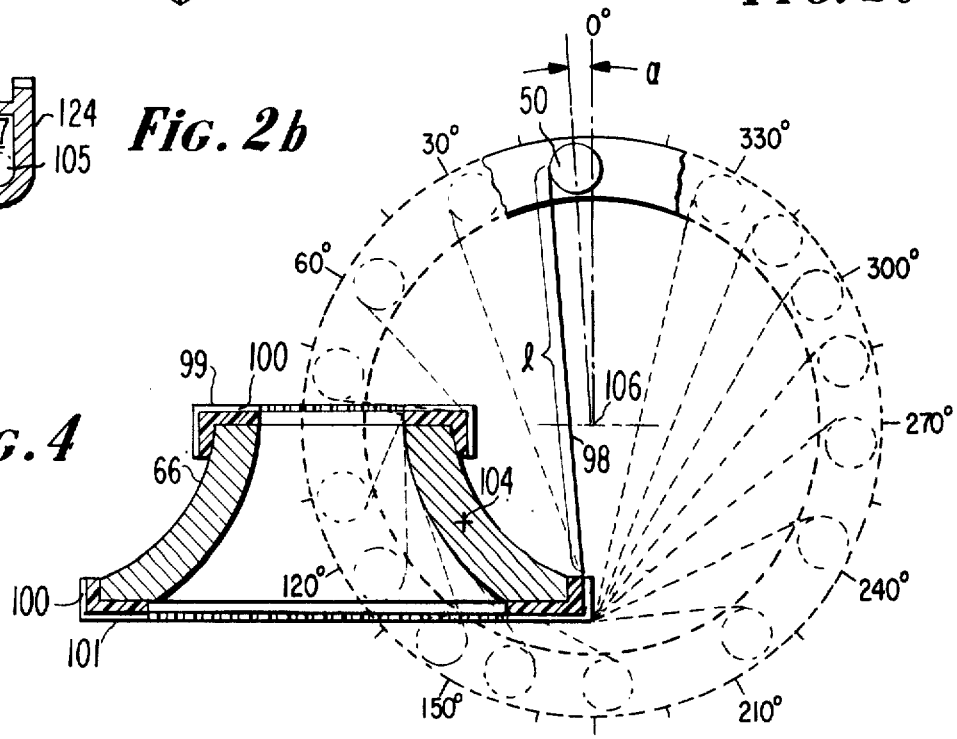

Disposed above jaw 76 is pivot block 86 which is pivotally mounted to support member 74. Knurled stud 88 is threaded through block 86 into contact with the upper surface of jaw 76 to releasably secure jaw 76 against insert 99 (FIG. 4). Support member 74 is secured to horizontal member 92 which is pivotally mounted to clamp base 94 at pivot pin 96. Clamp assembly 68 has an upright clamp position as illustrated in FIG. 1, and a lowered unclamped position as illustrated by clamp assembly 70 of FIG. 1. Suitable locking means, (not shown) lock the clamp assemblies 68 and 70 in the upright position.

Core 66 is secured between jaws 76 and 72 in either of clamp assemblies 68 or 70. When the core is approximately fifty per cent wound with a coil, an operator raises the lowered clamp assembly, for example assembly 70, clamps assembly 70 to the core and disengages assembly 68, lowering assembly 68 out of the way. In this manner, a setup need not be disturbed nor the machine stopped during a coil winding procedure until the complete coil has been wound around the core. For example, as illustrated in FIG. 2*a*, core 66 is clamped on the unwound portion while the winding proceeds around the unclamped portion of the core. In FIG. 3, the wound portion of the clamp is now clamped by assembly 70 and the unwound portion of the clamp formerly clamped by assembly 68 is now being wound by the machine.

In winding a coil such as a toroidal coil about a television deflection yoke, as illustrated in FIG. 2*a*, shuttle 38 rotates in a counterclockwise direction looking into the drawing so as to pass filament 98 (FIG. 2*c*) between tension and guide plates 48 during a portion of each turn so as to guide the filament into the proper serration 100 as described above. Filament 98 being wrapped around guide roller 50 is pulled by guide roller 50 from one of the bundles, for example bundle 102, in magazine 36. As the shuttle 38 rotates, roller 50 pulls the filament 98 from the magazine and rotates the floating magazine 36 in the direction of rotation along with shuttle 38 unless otherwise provided for.

Since magazine 36, unless otherwise provided for, would rotate freely when filament 98 is pulled therefrom, suitable braking action is provided by friction belt 44 (FIG. 1) and reversely driven air motor 34.

In prior art winding machines, the rate of rotation of shuttle 38 is constant during the winding of a coil turn. As a result, severe jerking motions are induced into magazine 36 by friction belt 44 and air motor 34 during the process by which tension is maintained on filament 98. These severe motions are related to the amount of filament 98 disposed between guide roller 50 and core 66 and are such that the stresses induced in filament 98 may break the filament.

The nature of this action will now be further explained with respect to FIGS. 4–7 wherein the zero degree angular reference point is the same in each of the several drawings. FIG. 4 shows a side schematic view of the relationship between guide roller 50 on shuttle 38, core 66 and dispensed portion of filament 98. The diameter of guide roller 50 path is, in the preferred embodiment, approximately 8 inches while the diameter of the transverse small neck of core 66 is approximately 2+ inches. The bottom larger core outer diameter is approximately 4 inches to 5 inches. As a result of the interlocking relationship between shuttle 38 and core 66 an eccentricity is introduced between the path of guide roller 50 with respect to the coil being wound which is centered approximately at 104, the shuttle center being at 106. This eccentricity or off-set causes length (l) of filament 98 disposed between guide roller 50 and core 66 to vary significantly in accordance with the angular position of roller 50 with respect to the center 106 of shuttle 38.

For example, with roller 50 in the 270° to 0° positions, the length (l) of filament 98 is more than three times as great as the length (l) of filament 98 when roller 50 is in the 90° position. The length of filament 98 is shortest when roller 50 is in the 90° position and then increases as shown till it reaches a maximum length approximately when the roller 50 is again in the 270° position and from there on decreases until in the 90° position. However, some of these changes in lengths occur abruptly as when roller 50 is in the 45° to 90° positions and when the roller is in the 180° to 45° positions.

When shuttle roller 50 enters the 45° position, air motor 34 tends to decelerate the angular velocity of magazine 36 to a point short of zero velocity to maintain tension on filament 98. This causes excessive jerking and extreme stresses on the filament 98. As roller 50 progresses from the 90° position to the 180° position, the magazine accelerates as filament demand increases and filament is pulled out of the magazine at a higher rate. In effect, between 90° and 270° positions, the filament is increasing in length (l). Thus there are abrupt shifts in the feed rate of filament 98 from magazine 36 in accordance with the angular position of shuttle 38.

In accordance with the present invention, a coil winding machine is provided in which there is provided an increased winding rate without sacrificing quality of the coil and without breakage of the filament during the winding period. This is provided by varying the shuttle speed during the winding of each turn, that is, during each 360° rotation of guide roller 50 about shuttle center 106 so as to maintain a substantially constant feed of filament 98 from magazine 36 regardless of the change in length (l). Means are provided so that magazine 36 does not abruptly change its angular velocity and, in fact, is provided a substantially constant velocity in a given direction. In essence, shuttle 38 is varied in its angular velocity in accordance with the angular position of guide roller 50 on the shuttle with respect to center 106 of the shuttle. The angular velocity of shuttle 38 and roller 50 is determined so as to maintain the angular velocity of magazine 36 substantially constant and which is related to the length (l) of filament 98 then being wound disposed between guide roller 50 and core 66.

The relative angular velocities of the magazine and shuttle can be determined by well known kinematic relationships. However, it has been found that empirical determination of these values for a given size and shape core disposed on a shuttle and magazine having a given diameter is sufficient. These empirical relationships can be determined as follows.

By slowly rotating the shuttle in given measured increments so as to pull filament 98 from magazine 36, a plot of approximate magazine velocity to shuttle velocity can be made by measuring the amount of rotation of the floating magazine under load with respect to a given amount of rotation of the shuttle. Under actual operating conditions, these relationships may change slightly as a function of angular velocity, the frictional load on the filament as it is pulled from the stored bundle and other kinematic conditions. However, it will occur to those skilled in the art that these effects will be negligible with respect to the magnitude of the shifts in relative angular positions of the shuttle and magazine as a result of the changing lengths (l) of filament 98. It is these latter effects which have dominant control over the relative angular velocities of the shuttle to magazine in the embodiment illustrated.

As an example of the differences between the angular velocities of the shuttle and magazine, an inspection of FIG. 5 reveals the following. At the 0° position there is an approximate 0.55 ratio between the magazine velocity to the shuttle velocity. As roller 50 approaches the 45° position, the ratio reaches a minimum at a ratio of slightly more than 0.4. Between the 45° position and the 90° position, the ratio goes from a minimum 0.4 to a maximum of almost 1.7. It is clear from FIG. 5 that there is an abrupt change in the ratio of the velocity of the magazine to the shuttle between the 45° and 90° position of roller 50 as evidenced by the changes in length (l) of the filament described in connection with FIG. 4.

Between the 90° position and the 180° position, there is relatively little change in the ratio of magazine velocity to shuttle velocity. However, between 180° position through the 360° position and back to the 45° position, the ratio decreases approximately linearly until the minimum value of the ratio is reached and the cycle repeats as will be explained.

Figure 6:
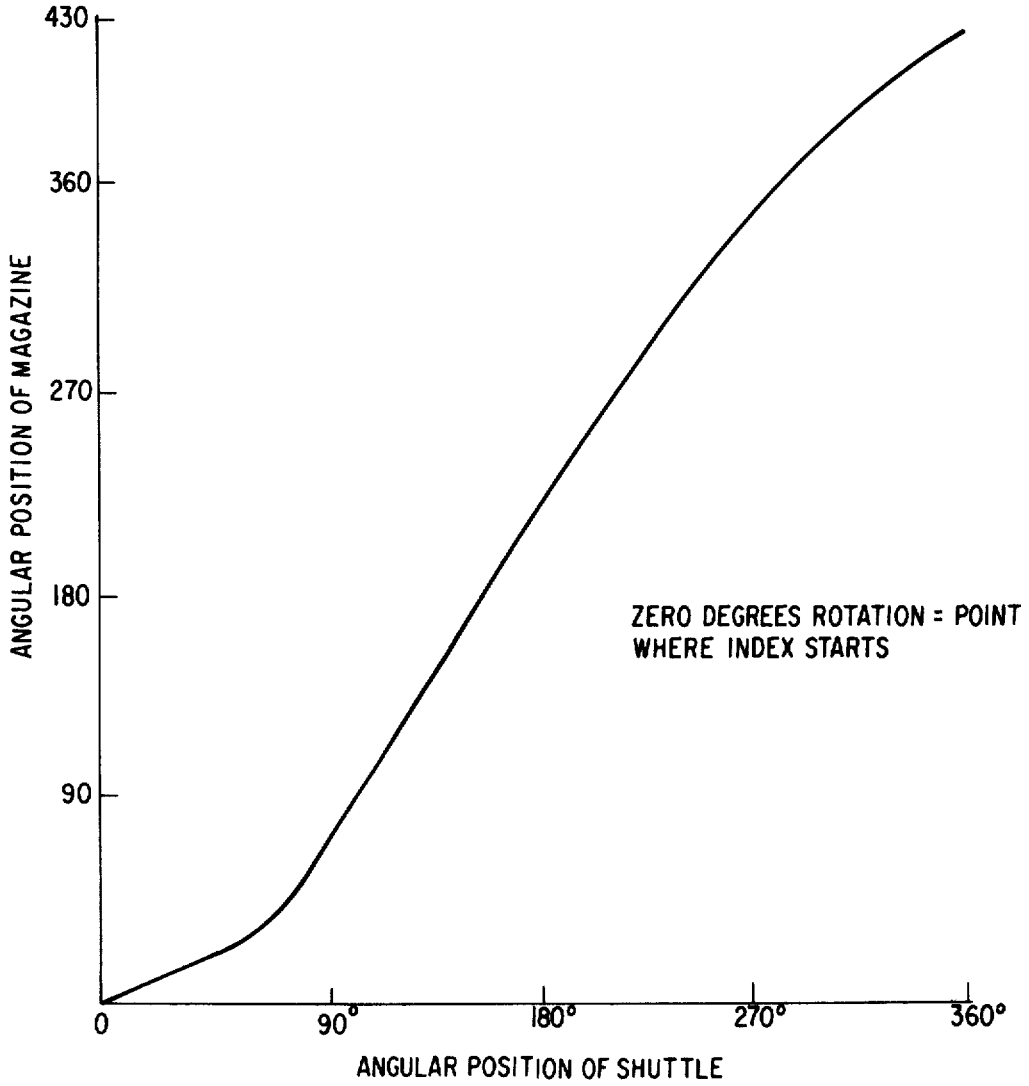

In FIG. 6 there is a plot of the angular position of the shuttle with respect to the angular position of the magazine, both the magazine and the shuttle starting out at the 0° position. It is seen that the shuttle reaches the 180° position when the magazine is approximately in the 225° position and the shuttle reaches the 360° position when the magazine is in the 70° position the second time around. Thus the magazine tends to advance on the shuttle even though the shuttle pulls the magazine by way of filament 98.

In FIG. 7, which is a plot of actual shuttle and magazine velocities in revolutions per second versus angular position for a machine built and operated in accordance with the present invention, it is seen that to maintain a magazine velocity of one revolution per second between the 45° and 90° position of the shuttle, the shuttle rotation is decreased rapidly from approximately 2.4 revolutions per second to 0.6 revolutions per second, while between the 90° position and the 180° position, the shuttle is maintained at a substantially constant rate of 0.6 revolutions per second. Between 180° and 360° and thence to approximately 45°, the shuttle angular velocity is then increased as shown. In practice, a substantially constant angular velocity is provided the shuttle between 90° and 180° as well as between 30° and 50° to simplify construction of the machine. These latter deviations from the plotted curve result in negligible effect on the winding of a coil in the operation of the machine.

In FIG. 3 there is diagrammatically illustrated the various machine controls which enable shuttle 30 and magazine 36 to have angular velocities that follow the relationships indicated in FIG. 7. Program control 110 applies a control signal to function generator 112. Program control 110 is preferably a suitable tape and tape reader apparatus (not shown) for performing a plurality of predetermined sequential functions which include starting and stopping the machine, interacting with safety devices on the machine, and for controlling cyclic functions which have time periods longer than the time period of a single rotation of the shuttle as will be explained, the running tape providing the instruction for these cyclic functions in conjunction with a synchronizing signal provided by the rotating shuttle.

Coupled to shuttle 38 is position sensor 118 which serves to provide a signal indicating when the shuttle is in certain predetermined angular positions. This position indicating signal is applied to function generator 112. Position sensor 118 is schematically shown as a device placed adjacent shuttle 38. In practice, sensor 118 is any suitable device which will indicate the angular position of shuttle 38 and may be located anywhere on the machine. For example, in a machine actually built, position sensor 118 is a thin disk cam made of permeable iron or the like mounted on a shaft geared to rotate 1:1 with shuttle 38. The cam has a vane which interrupts a magnetic field so as to operate a magnetic reed type switch whenever the shuttle is in a predetermined angular position. In effect, the reed switch serves to open and close circuits (not shown), as the case may be, in function generator 112 when the shuttle is in the predetermined angular position. The number, configuration and angular placement of the reed switches and cams provided will depend on the number of functions provided by generator 112 in accordance with any given winding configuration. It will occur to those skilled in the art that other equally effective position sensing devices may be provided to indicate the angular position of shuttle 38 and to provide related synchronizing signals as desired.

Some of the functions performed by the signals generated by position sensor 118 include switching a circuit in function generator 112 so as to cause function generator 112 to provide a signal which controls and shifts the angular velocity of shuttle 38. Another function of position sensor 118 is to switch a circuit in function generator 112 to provide a signal which causes indexing motor 60 to rotate upon receipt of a signal applied to function generator 112 by program control 110. Another function is to switch a circuit in function generator 112 in conjunction with a signal applied by program control 110 so as to stop shuttle 38 in a given angular position. A still other function is to generate a tape block read signal to cause the tape reader of program control 110 to read a block of instructions for the applicable instruction to be applied in accordance with the state of the coil then being wound.

Preferably function generator 112 is a suitable device which generates voltage output signals at leads 114 and 116 in accordance with signals received from program control 110 and position sensor 118. One of these voltage output signals applied to lead 114 has a magnitude that varies in level in accordance with a predetermined pattern. This pattern is proportional to the shuttle waveform of FIG. 7 and, in fact, approximates this waveform. This pattern repeats itself for each turn of the coil being wound in those cases, where the indexing of the coil between turns has negligible effect on the relative angular velocities of the shuttle and magazine. For example, where there is less than 2° between adjacent turns. It is to be understood that where the indexing does have an effect on these relative angular velocities, as for example in 30° segments between adjacent turns, then the waveform of FIG. 7 need be revised accordingly and does not repeat during the indexing of this turn of the coil. To determine the waveform of the voltage applied to lead 114 in accordance with any indexing pattern is within the skill of the art and no further description will be given herein of these various embodiments.

The waveform on lead 114 is applied to voltage controlled oscillator pulse generator 120. Pulse generator 120 is a conventional voltage controlled generator having a pulse train output signal whose frequency is a function of the level of the applied input voltage. For driving shuttle 38 where adjacent turns are indexed about 2°, the output of generator 120 will have a frequency proportional to the shuttle waveform of FIG. 7. This variable frequency output signal is applied to stepping motor 30 which rotationally drives shuttle 38 in accordance with the frequency of the signal applied as an input thereto.

Preferably generator 112 includes two suitable rc networks (not shown) which respectively generate the deceleration voltage occurring between 45° and 90° (FIG. 7) and the acceleration voltage occurring between 180° –360° –45°. Generator 112 includes additional conventional circuitry for generating a constant voltage between 90° and 180°. Since the generated voltage of generator 112 can be an approximation of the shuttle curve of FIG. 7, the acceleration, deceleration and constant voltages are, in practice, provided substantially linear. Additionally, a constant voltage between 30° and 50° may also be provided to flatten out the peak therebetween. By advantageously using rc networks to provide the acceleration and deceleration portions of the predetermined pattern, the switching action of position sensor 118 need occur only at the start of the up or down ramp, as the case may be, of the voltage waveform. The maximum and minimum constant voltage levels are provided by conventional circuitry in generator 112. As a result, the switches of position sensor 118 may be returned to their original state any time prior to the completion of a single revolution of the shuttle so as to be ready for the next occurring up or down ramp action. With two rc networks, then, position sensor 118 provides at least two suitable switching actions. One when the shuttle is at the 40° position to start the down ramp voltage and the other at the 180° position to start the up ramp voltage.

Generator 112 includes additional conventional circuitry for providing an output voltage on lead 116 in accordance with a second predetermined pattern. The voltage on lead 116 preferably has two levels which manifest either a motor 60 on or off condition. This voltage is applied to voltage controlled oscillator pulse generator 122 for generating a stream of pulses as a function of the applied voltage level similar to pulse generator 120. In this instance the output of generator 122 is applied to motor 60 which serves to index table 58 so as to place the various turns of the coil being wound in predetermined position around the core 66. This signal is applied to motor 60 to drive motor 60 when shuttle roller 50 is between the 0° to 45° positions when filament 98 is firmly seated in serration 100 of insert 101 and prior to insertion of filament 98 in serration 100 of insert 99. The pulse repetition rate of the output signal of generator 122 is generally not critical. Generally, this rate is constant.

In the embodiment illustrated using a television deflection yoke core, indexing takes place when guide roller 50 is between the 0° position and the 45° position, as best seen in FIG. 4. That is, indexing of the core from one turn to the next turn occurs when filament 98 is wound on the exterior portion of the coil. The relationships between the magazine and shuttle velocities, as illustrated in FIGS. 5, 6 and 7, include indexing of the core in the 0° to 45° sector of the shuttle guide roller 50.

It will be appreciated that when indexing occurs for each turn, position sensor 118 provides the synchronizing switching action that turns on the voltage applied to lead 116. However, when indexing action occurs for a large sector of the coil on core 66 it will be recognized that the shuttle need be slowed down or the indexing table speeded up in order to facilitate these actions as quickly as possible. Since this may be a one time occurrence in a given coil, synchronism for this action is provided by a signal from program control 110 which at the appropriate time during the coil winding generates a function shift signal which is applied to function generator 112. This, for example, may be provided by means in program control 110 which counts the number of cycles of shuttle 38 as provided by a signal from position sensor 118. Function generator 112 is then caused to shift back to its original or other designated function when this special cycle is completed.

Preferably, this machine is started with shuttle 38 in a given position when the position sensor includes means for indicating only a change in angular velocity of shuttle 38, as for example, the three switch action described above with respect to starting the up and down ramp voltages and for indicating the start of the indexing action of table 58. In this case, there is an open loop configuration between the shuttle 38 and program control 110. That is, program control 110 does not know the exact position of shuttle 38. To provide start up synchronism between shuttle 38 and program control 110 suitable safety means (not shown) are included to prevent start up of the machine except when the shuttle is in a given position. Here, the start up is conveniently provided when shuttle roller 50 is in the 0° position. This may vary an amount $\alpha$ (FIG. 4) in accordance with a particular application. Consequently, program control 110 includes means for stopping the shuttle in this 0° position when a core 66 has been completely wound and for preventing start up when the shuttle is in any other position. This, it will be recalled, is one of the functions of program control 110 described above. In this case the tape of program control 110 would cause function generator to generate a signal such that when shuttle 38 reaches the 0° position, the machine is programmed to stop and ready to start the next coil.

As indicated above, suitable rc networks are provided to generate the desired functions for controlling the angular rate of shuttle 38. It will occur to those skilled in the art that other suitable embodiments to shift the angular rates of motor 30 may be provided. Such other embodiments would include a cam operated potentiometer which is engaged with the cam surface of a cam wheel driven in synchronism with shuttle 38. The potentiometer, in accordance with the position of the cam, will have a resistance which varies in accordance with the angular position of the shuttle. This resistance necessarily would change the level of voltage thereacross shifting the voltage level in synchronism with the shuttle 36.

In FIG. 2 it will be seen that the stored bundle of filaments 102 occupies one groove 55 of a double grooved magazine 36, the second groove being shown at 57. A second bundle of filaments 105, shown in phantom, is stored in groove 57. After bundle 102 is wound into a coil on core 66, bundle 105, stored in groove 57, is then applied to core 66 for winding a second coil without breaking the setup. As illustrated in FIG. 2*b*, the double grooved magazine includes two outer walls 124 and 126 and an intermediate wall 128. A second grooved filament guide 130 is placed adjacent guide roller 50 on the interior side wall of shuttle 38 to further enhance the guiding of the filament from magazine 36 to guide roller 50.

Thus as described above, a machine built and operated in accordance with the present invention, provides means for sensing the angular position of the shuttle and means responsive to this sensing means for controlling the shuttle velocity so as to maintain the magazine velocity constant. This provides a constant feed rate of the filament from the magazine to the shuttle permitting faster shuttle velocities during that sector of each turn in which rapid shuttle speeds may be permitted and slower shuttle speeds when that sector of each turn in which the corresponding amount of filament provided is reduced increasing the overall winding rate of the machine.

What is claimed is:

1. In a winding machine for winding a toroidal coil about a hollow core the combination comprising:

a rotatably mounted floating annular magazine for storing filament to be wound into said coil and arranged to be linked with said core, a rotatably mounted annular shuttle arranged to be linked with said core for withdrawing the filament from said magazine and for guiding the filament on to said core, the withdrawing of said filament rotating said magazine, rotation restraining means coupled to said magazine for inhibiting the rotation of said magazine during said withdrawing, and shuttle drive means including an electric motor and preprogrammed motor energizing means coupled to said motor for causing said motor to rotate the shuttle at an angular rate which varies in each rotation of the shuttle in accordance with the angular position of the shuttle to withdraw the filament from the magazine at a constant rate.

2. The combination of claim 1 wherein said preprogrammed means includes position sense means coupled to said shuttle to sense the angular position of said shuttle and provide a shuttle position signal as an output therefrom and motor synchronizing means coupled to said sense means and responsive to said position signal applied as an input thereto for synchronizing the operation of the preprogrammed motor energizing means with the operation of said shuttle.

3. The combination of claim 2 wherein said preprogrammed energizing means includes a function generator means synchronized by said position signal for generating an electrical function signal for energizing said electric motor.

4. The combination of claim 3 wherein the electric motor is a stepping motor and said motor energizing means includes pulse generator means for producing a stream of pulses having a pulse repetition rate corresponding to said function signal.

* * * * *